United States Patent [19]

Carlin

[11] Patent Number: 4,643,434

[45] Date of Patent: Feb. 17, 1987

[54] ARCHERY TARGET AND METHOD

[76] Inventor: Eugene C. Carlin, 351 Lockheed Ave., Marietta, Ga. 30060

[21] Appl. No.: 633,345

[22] Filed: Jul. 23, 1984

[51] Int. Cl.[4] ..... F41J 3/00

[52] U.S. Cl. ..... 273/408; 264/46.6; 428/16; 428/317.5; 425/110

[58] Field of Search ..... 273/408, 407, 404; 264/46.4, 46.5, 46.6; 428/317.5, 71, 76, 16

[56] References Cited

U.S. PATENT DOCUMENTS

| | | | |
|---|---|---|---|
| 2,122,372 | 6/1938 | Hooper et al. | 264/46.6 X |
| 2,818,258 | 12/1957 | Stern | 273/404 |
| 3,163,418 | 12/1964 | Myers | 273/408 |
| 3,411,967 | 11/1968 | Rowland et al. | 428/317.5 X |
| 3,415,714 | 12/1968 | Hider | 428/317.5 |
| 3,511,738 | 5/1970 | McGuire | 428/71 |
| 3,699,714 | 10/1972 | Johnson et al. | 264/46.6 X |
| 4,054,288 | 10/1977 | Perrine, Sr. | 273/407 |
| 4,092,387 | 5/1978 | Parsson et al. | 264/46.6 |

*Primary Examiner*—Paul E. Shapiro
*Attorney, Agent, or Firm*—B. J. Powell

[57] ABSTRACT

An archery target comprising a foamed plastic core and a cover bonded directly to the core by the material of the core with the cover serving to retain the core in place when penetrated by arrows.

11 Claims, 11 Drawing Figures

ARCHERY TARGET AND METHOD

BACKGROUND OF THE INVENTION

This invention relates generally to targets and more particularly to archery targets.

Many different materials have been suggested for use as archery targets such as straw, cardboard and foam plastic materials. By in large, these prior art archery targets have not been self-supporting and thus required a stand or other supporting surface on which the target was mounted. Moreover, the arrows which could be used in practice with these prior art archery targets were virtually limited to arrows with field tips rather than arrows with broad head tips typically used for hunting. This is because the target damaged the broad head tip or the broad head tip cut the target so that the target was damaged. More particularly, those archery targets which were made of foam plastic material deteriorated rapidly during use so that the target had to be frequently replaced or repaired. Examples of archery targets that use foam plastic material are shown in U.S. Pat. Nos. 3,244,419 to Lerman; 4,054,288 to Perrine, Sr.; 4,066,261 to Stewart; and 4,235,444 to Meyer. A rolled corrugated cardboard target is shown in U.S. Pat. No. 3,048,401 to Dishon.

SUMMARY OF THE INVENTION

These and other problems and disadvantages associated with the prior art are overcome by the invention disclosed herein by providing an archery target which includes a foam plastic core with a covering enclosing the core and bonded to the surface of the core by the material of the core itself. The covering serves to maintain the core in place as it is penetrated by arrows and as the arrows are withdrawn. The core is made out of foamed polyurethane of the rigid or closed cell type so that the core is self-supporting and serves to support the target on the ground. Thus, stands or other supports are not required. The covering is typically corrugated cardboard with the core having been foamed in place within the covering to bond the covering to the core. This permits the use of arrows equipped with broad head tips to be used for practice without damaging the arrows themselves. The covering retains the core in place as arrows are removed to reduce deterioration of the target. The covering defines an opening therethrough in the peripherial edge of the target around which is mounted a recess form member that projects down into the foamed core to provide a hand-holding recess to carry the target. The recess form member has sufficient strength to prevent the collapse of the member as the core is foamed in place.

The method of the invention includes covering the inside of a mold with the material to be used for the covering, injecting the material to be foamed into the mold within the covering and foaming the core member so that the curing of the material of the core inherently bonds the covering to the core. The method also includes the step of imposing a vaccum on the covering in the mold to keep the covering in place within the mold until the core is foamed. The method also includes injecting the material to be foamed for the core into the mold through an opening in the mold and covering and then inserting a recess form member through the open end of the mold. The recess form member is positioned within the mold around the opening through the covering so that, as the core is foamed, the recess form member is fixed in place and forms a recess in the target. The handle is positioned in the recess form member prior to foaming the core so that the handle is also locked in place as the core is foamed.

These and other features and advantages of the invention will become more clearly understood upon consideration of the following detailed description and accompanying drawings wherein like characters of reference designate corresponding parts throughout the several views and in which;

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
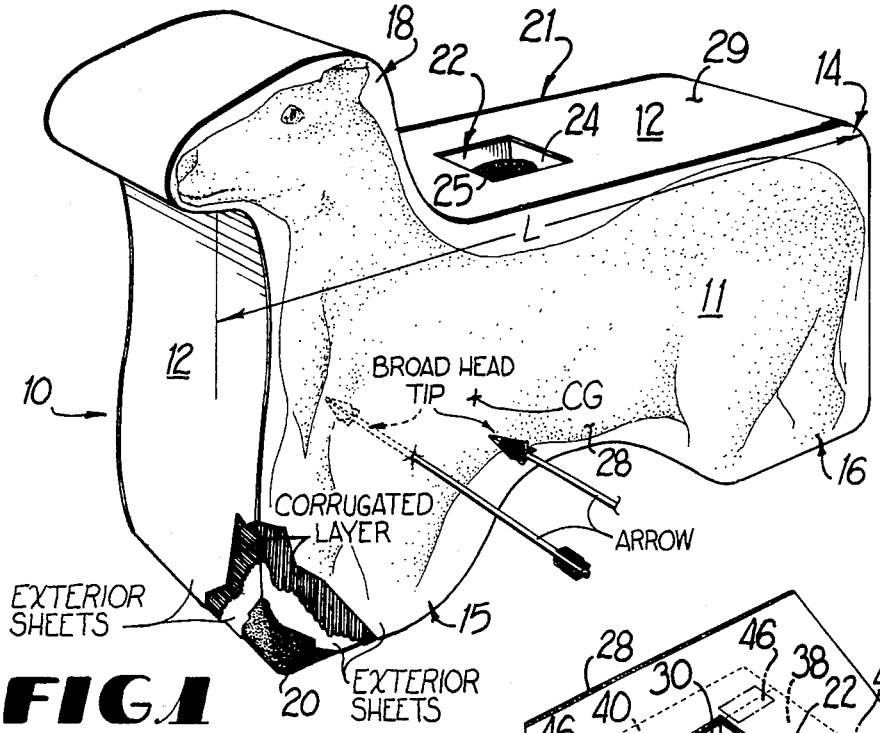
FIG. 1 is a perspective view of the target of the invention.

Referring to FIG. 1, it will be seen that the target 10 has a pair of opposed side surfaces 11 which serve as the primary area in which the arrows are shot with a peripherial surface 12 extending around the edge of the target 10. It will be appreciated that the target 10 may have any desired configuration such as being round, rectangular and the like and is illustrated as having a general outline corresponding to that of an animal such as a deer. As such, the target has an elongate body section 14 with depending front and back leg sections 15 and 16 and an upstanding head section 18.

The target 10 has a core 20 with a covering 21 extending therearound and covering the exterior surfaces or the core 20. The core 20 bonds itself to the covering 21. An opening 22 is provided through the covering and is enclosed by a recess form member 24 equipped with a handle 25 so that the target can be lifted by the handle 25 to move it.

The core 20 is a rigid, foamed polyurethane with a closed cell structure so that the core is self-supporting, thereby eliminating the need for any separate supporting structure for the target 10. The core has a free-rise density of about 3–5 pounds per cubic foot. While any of a variety of materials may be used for the core 20, a two-part urethane system sold by North Carolina Foam Industries, Inc. in Mount Airy, N.C. as their Pour-in-Place System No. 5-158 has produced a satisfactory core 20. This material bonds itself directly to the covering 21 as will become more apparent.

The covering 21 includes a pair of side pieces 28 which cover opposite sides of the core 20 with a peripherial edge piece 29 extending around the edge of the core 20 between the side pieces 28. While different materials may be used for the covering 21, it has been found that corrugated paperboard works well as the covering material. As is typical with corrugated paperboard, each of the pieces 28 and 29 has a corrugated layer sandwiched between two exterior sheets of paperboard. The corrugated layer of the edge piece 29 is arranged so that the corrugations run transversely of the longitudinal axis of the target 10 so that the edge piece can bend around the curves in the edge of the target. The side pieces 28 are substantially flat and the corrugations in the corrugated layer of the side pieces may be arranged so that they run vertically as illustrated or horizontally. Since the side pieces 28 and edge piece 29 are bonded directly to the core 20, these pieces serve to retain the core in place as arrows penetrate the covering 21 and core 20. This is especially true with arrows equipped with broad head tips which tend to cut up the core 20. The side pieces 28 prevent plugs from being pulled out of the core 20 during use.

Surprisingly, it has been found that arrows with broad head tips can be fired into the target 10 without damage to the arrow or the blades on the broad head tip. Further, the polyurethane material of the core serves to sharpen the broad head tips as the arrows are used so as to maintain the blades on the tip in a sharpened condition. Thus, it will be seen that the target 10 permits the use of the broad head tip in a more realistic practice than that of previous targets which required the use of field tips on the arrows.

The edge piece 20 defines the generally square opening 22 therethrough at the top of the target. The recess form member 24 is positioned within the target 10 below the opening 22 yet provides a recess 30 therein so that the user can carry the target by grasping the handle 25 extending through the recess form member 24. It will be appreciated from FIG. 4 that the core 20 extends up around the recess form member 24 to keep it in place with the form member 24 being bonded directly to the core 20. As will become more apparent, the recess form member 24 permits the core to be foamed in place while maintaining an internal pressure in the core to control its density.

Figure 3:
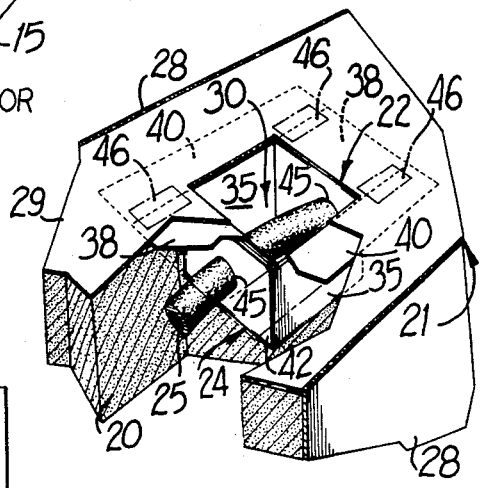
FIG. 3 is a perspective view illustrating the recess form member set up.
Figure 2:
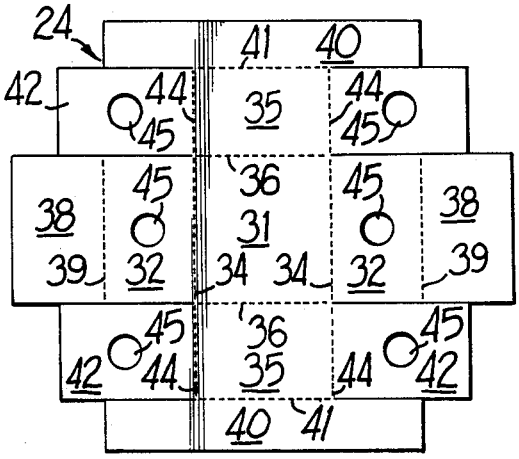
FIG. 2 is a plan view of the blank from which the recess form member is made.
Figure 4:
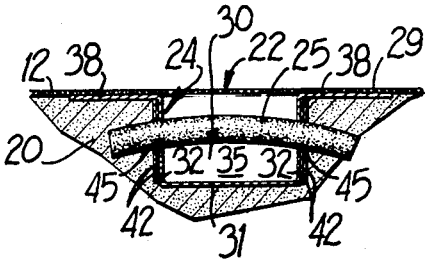
FIG. 4 is a cross-sectional view taken generally along line 4—4 in FIG. 1 showing the recess member in place.

The recess form member 24 is shown in its flat blank condition in FIG. 2 and in its set up condition in FIGS. 3 and 4. As seen in FIG. 2, member 24 is made from a corrugated paperboard sheet and includes a bottom panel 31 integrally joined with a pair of opposed end panels 32 along one set of opposed edges thereof at parallel fold lines 34. The other opposed edges of the bottom panel 31 are integrally joined to a pair of opposed side panels 35 along parallel fold lines 36. The outer edge of each of the end panels 32 is integrally joined with an end flap 38 along fold line 39 parallel to the fold line 34. The outer edge of each of the side panels 35 is integrally joined with a side flap 40 along fold line 41 parallel to the fold line 36. As will become more apparent, the opposed side edges of each of the side panels 35 are integrally joined to opposed locking panels 42 along fold lines 44 normal to fold lines 36 and 41. The end panels 32 and locking panels 42 are each provided with a central hole 45 of a common diameter.

As will become more apparent, the bottom panel 31 is rectilinear and is illustrated as square. The length and width of the panel is selected to correspond to that of the opening 22 through the edge piece 29 of covering 21. The end, side and locking panels 32, 35 and 42 have a common height less than the length and width of the bottom panel 31. The side flaps 40 each have a projecting length normal to fold line 41 such that the combined height of side panel 35 and projecting legth of side flap 40 is no greater than the length and width of the bottom panel 31 to facilitate the placement of the recess form member 24 in the target 10 as will become more apparent. The locking panels 42 are sized to correspond to that of the end panels 32 so that the panels 42 will register with the panels 32 when the recess form member is set up. The side flaps 40 have a transverse width greater than the width of the side panels 35 so that opposite ends of each side flap 40 project out past the side edges of side panel 35 a distance equal to the projecting length of the end flaps 38 so that the side flaps 40 line up with the end flaps 38 when the recess form member is set up.

Figure 9:
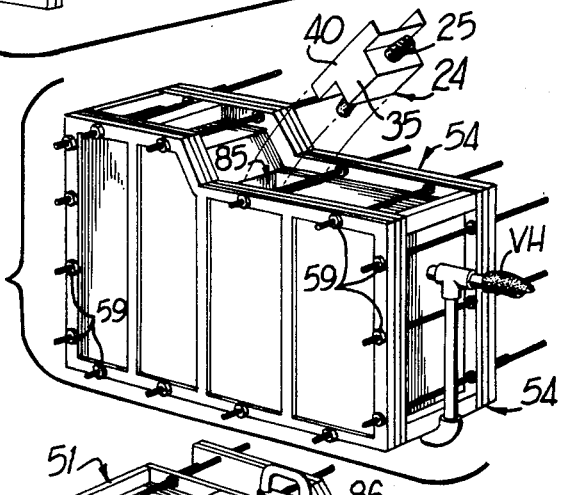

To set up the recess form member 24, the end panels 32 are folded up to a position substantially normal to the bottom panel 31. The side panels 35 are then folded up to a position normal to bottom panel 31 and the locking panels 42 folded behind the end panels 32 to overlap each other. With the holes 45 in registration, the handle 25 is inserted through the registered holes in the locking panels 42 and end panels 32. This locks the recess form member 24 in its set up condition. The handle 25 is illustrated as a piece of elastomeric hose to permit a snug fit in holes 45. The length of handle 25 is not critical provided it is longer than distance between opposite sides of the member 24. The end flaps 38 and side flaps 40 are then folded outwardly so that they are generally parallel to the bottom panel 31. These portions of the side flaps 40 which line up with opposite ends of the end flaps 38 can be connected thereto by tape 46 seen in phantom lines in FIG. 3 or any other convenient means. This serves to keep the end flaps 38 folded outwardly as the recess form member is inserted through opening 22 as will become more apparent. To fit the recess form member through the opening 22 in the edge piece 29, the side flaps 40 are folded up to a position coplanar with the side panels 35 as seen in FIG. 9 as will become more apparent.

FIGS. 3 and 4 show the fully set up recess form member 24 in place within the target. The end and side flaps 38 and 40 lie against the underside of the edge piece 29 around the opening 22 therein and thus seal off the core 20 at the opening 22. As will become more apparent, the form member 24 is bonded directly to the core 20 by the material of the core.

Figure 5:
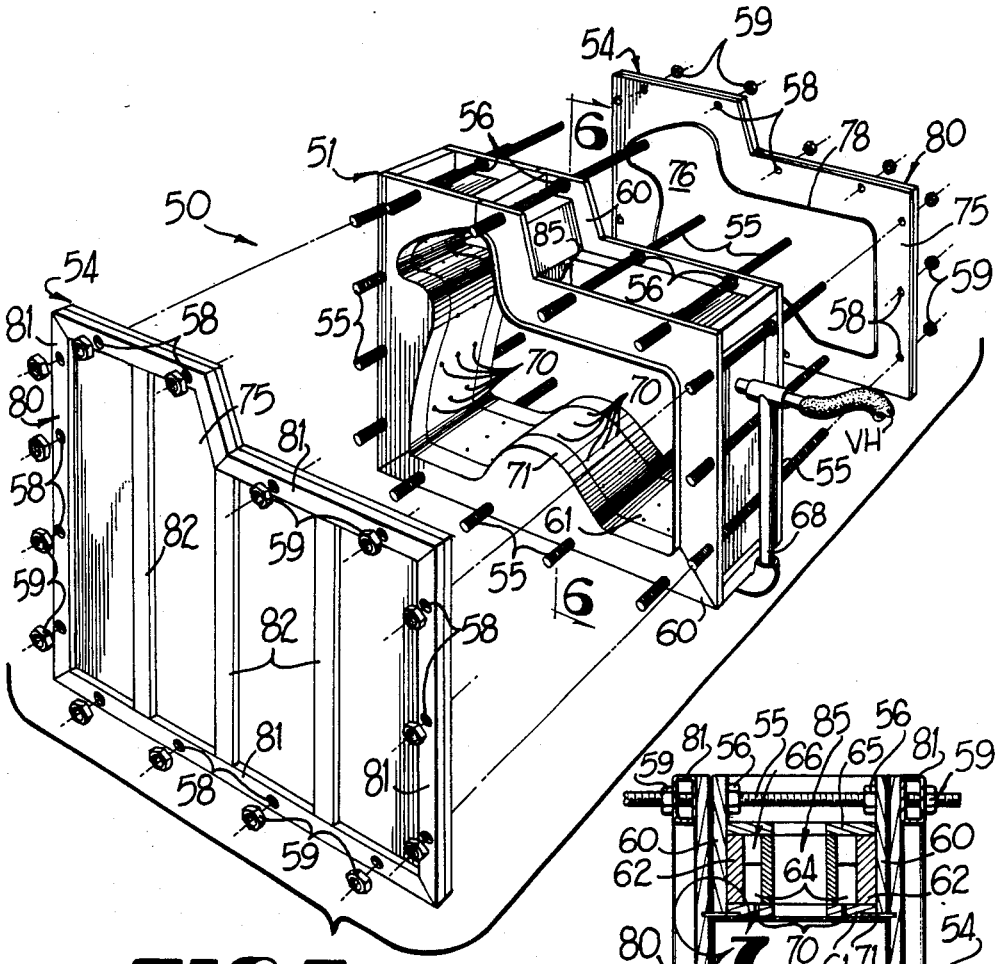
FIG. 5 is an exploded perspective view of the mold used in fabricating the target.
Figure 6:
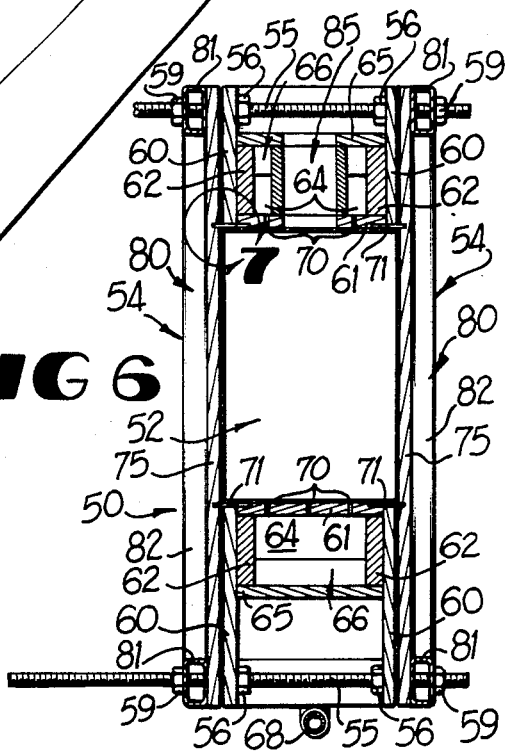
FIG. 6 is a cross-sectional view taken generally along line 6—6 in FIG. 5 with the mold in use.
Figure 7:
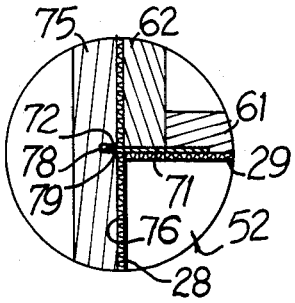
FIGS. 7—10 illustrate the target being made in the mold.

The target 10 is made in the mold 50 seen in FIGS. 5–7. Mold 50 include a central unit 51 which defines the mold cavity 52 therethrough and a pair of side panel assemblies 54 to fit against opposite sides of the central unit 51 to close the mold cavity 52. While different mechanisms may be used to removably mount the side panel assemblies 54 on the central unit 51, a plurality of threaded rods 55 are illustrated which are mounted around the periphery of the central unit 51 and project outwardly on opposite sides thereof. Nuts 56 locate the rods 55 in the central unit 51. The side panel assemblies 54 are provided with holes 58 around the periphery thereof which receive the rods 55 and nuts 59 lock the side panel assemblies in place.

The central unit 51 includes opposed side plates 60 with a cutout therethrough corresponding in shape to the peripheral edge of target 10. An edge support member 61 extends between the side plates 60 around the cutout to the edge of the mold cavity 52. The edge support member 61 is reinforced by edge members 62 mounted on the inside of the side plates 60 under opposite edges of the support member 61. Cross members 64 extend between the edge members 62 under the support member 61 for additional support. Closure plates 65 extend between the side plate 60 and rest on the outer edges of the edge members 62 to form an enclosed vacuum chamber 66 between the plates 65 and the edge support member 61. It will be seen that the edge members 62 are higher than the cross members 64 so that the vacuum chamber 66 extends around the mold cavity 52. Connector pipes 68 communicate with the vacuum chamber 66 so that a vacuum hose VH from a convenient vacuum such as a vacuum cleaner can be connected thereto to impose a vacuum in the chamber 66. The edge support member 61 is provided with a plurality of small vents 70 therethrough so that the vacuum in chamber 66 communicates with the mold cavity 52. As will become more apparent, this arrangement permits the edge piece 29 to be held in place while the target is being made.

A cutter blade 71 extends around the mold cavity 52 on each of the opposite sides of the central unit 51. These cutter blades 71 serve to cut the side pieces 28 of the target 10 to size and also insure that a good seal is made between the central unit 51 and the side panel assemblies 54. The cutter blades 71 are mounted so that their inside surfaces are flush with the inside surface of the edge support member 61. As best seen in FIG. 7, the outer edge 72 on each cutter blade 71 is sharpened to cut through the sheet of corrugated paperboard to form the side pieces 28 as will become more apparent.

Each of the side panel assemblies 54 of the mold 50 include a side panel 75 which has a shape corresponding to the peripheral shape of the central unit 51. The holes 58 therethrough receive the threaded rods 55 to mount panel 75. The inside surface 76 of each of the side panels 75 is planar to close the sides of the mold cavity 52. Each panel 75 defines a groove 78 therein complementary in size and shape to the cutter blade 71 against which the assembly 54 is to be positioned. The inside shoulder 79 adjacent groove 78 best seen in FIG. 7 serves to support the sheet of corrugated paperboard as it is being cut by blade 71 to form the side piece 28.

The outside of each side panel 75 in panel assembly 54 is supported by a side frame 80 to prevent it from collapsing as the target is being formed as will become more apparent. Frame 80 is made of tubular members with edge members 81 that extend around the periphery of the panel 75 and define the holes 58 therethrough. Cross braces 82 extend across the panel 75 between members 81 to keep the panel 75 flat.

To provide access to the mold cavity 52 after the side panel assemblies 54 are in place, an access opening 85 is formed through the top of the central unit 51. The access opening 85 has a transverse cross-sectional size and shape corresponding to that of the opening 22 through the edge piece 29 on the target 10. As will become more apparent, this opening allows the unfoamed components of the core 20 to be charged into the cavity 52 and the recess form member 24 and handle 25 to be inserted therethrough prior to foaming the core 20.

To facilitate the removal of the target 10 after it is made, the edge support member 61 forming the edge of cavity 52 is oriented to provide a release angle of one-three degrees across the central unit 51. As seen in FIG. 6, the threaded rods 55 are arranged so that one end of the rods project further out of the central unit 51 than the other. The larger end of the mold cavity 52 is located at the shorter ends of the rods 55 as will become more apparent.

Figure 8:
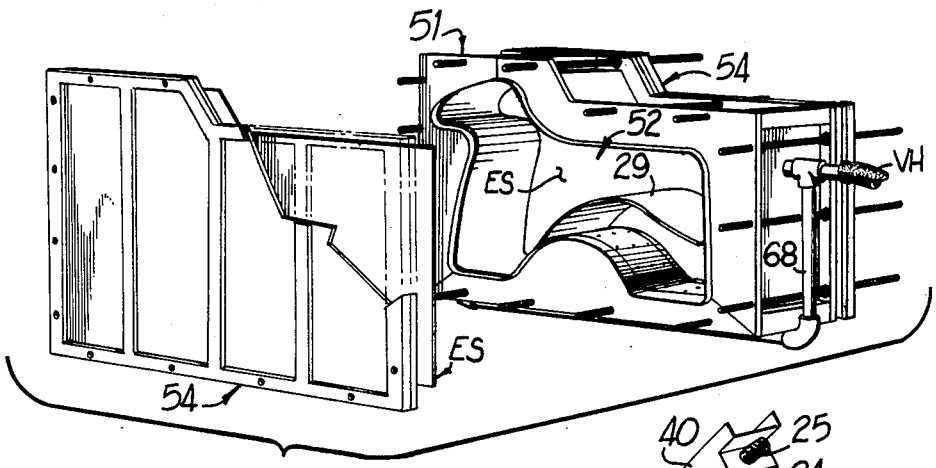
Figure 10:
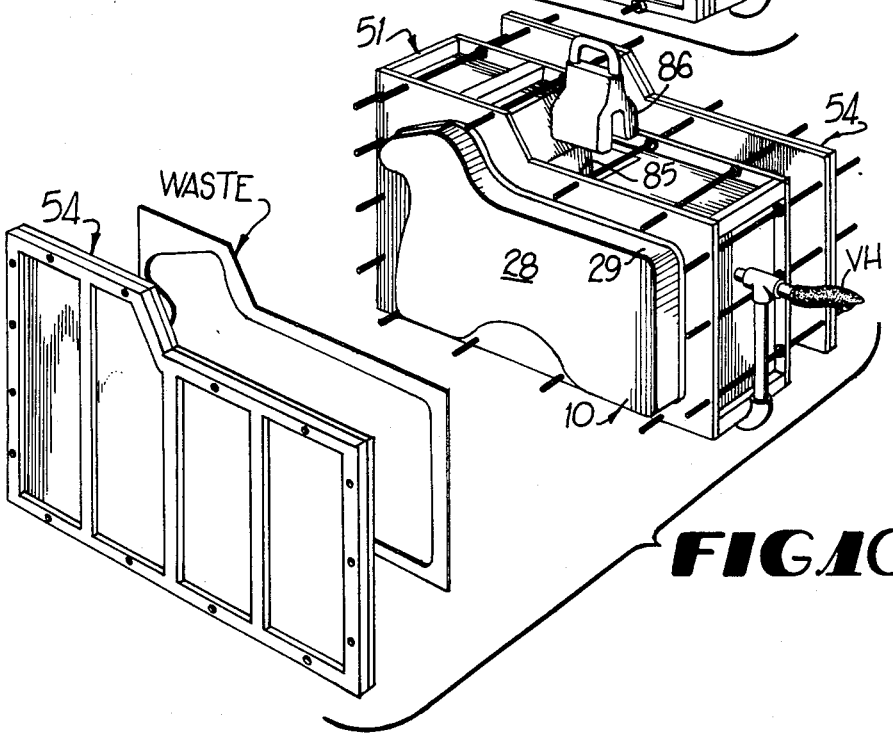

The manufacture of the target 10 will be best understood upon consideration of FIGS. 8–10. The mold 50 is first lined with the corrugated paperboard that becomes the side pieces 28 and edge piece 29. The unfoamed mixture of the material for the core 20 is then poured into the cavity 52 through the opening 85 and the recess form member 24 inserted before the core is foamed.

Referring more specifically to FIG. 8, the edge piece 29 is cut to size. With the vacuum applied through the vents 70, the edge piece 29 is laid around the edge of the mold cavity 52 with the vacuum holding the edge piece 29 in position. An edge sheet ES of corrugated paperboard larger than the side opening of cavity 52 is fitted between each side panel assembly 54 and the central unit 51 so that each overlies all of the cutter blade 71 facing it. As the nuts 59 are tightened, the cutter blades 71 will cut the edge sheet ES to exact size and form the side pieces 28 to fit in cavity 52. The outer edges of the newly formed side pieces 28 overlie the outer ends of the edge piece 29 and will shift the edge piece 29 until it is correctly lined up. It will thus be seen that the side pieces are cut to exact size by cutter blades 71 and a good edge finish is achieved. This also insures a good seal during foaming of the core 20.

After the edge piece 29 is in place and held by the vacuum imposed through vents 70, the opening 22 is cut through the edge piece 29 by cutting around the opening 85 in the central unit 51. The components of the core 20 are mixed and poured or injected into the cavity 52 through opening 85 in mold 50 and opening 22 cut in the edge piece 29. After the mixed components of the core are within cavity 52 and before enough time has elapsed for the core to foam, the set up recess form member 24 with the handle 25 in place as seen in FIG. 9 is inserted. The side flaps 40 on form member 24 are folded up until they are coplanar with the side panels 35 as seen in FIG. 9. This reduces the width of member 24 so that it can be turned on end and inserted through the opening 85 in mold 50 and opening 22 in the edge piece 29 by the operator. After the recess form member 24 is inserted, the operator continues to hold the handle 25 and allows the side flaps 40 to return to their outwardly turned positions. The operator then pulls the member 24 back up against the edge piece 29 so that the recess 30 in member 24 is in registration with the opening 22 through edge piece 29 and the flaps 38 and 40 lie against the inside surface of the edge piece 29. The operator holds the member 24 in place until the core has foamed enough to keep the member 24 in place. The operator then inserts a form 86 (FIG. 10) into the recess 30 and over the handle 25 to prevent the side panels 35 and end panels 32 from collapsing inwardly while the pressure within cavity 52 builds up due to the foaming of core 20. The vertical strength of the side panels 35, end panels 32 and locking panels 42 is sufficient to prevent the recess form member 24 from collapsing in that direction.

After the core 20 is fully foamed, the form 86 is removed as seen in FIG. 10 and the side panel assemblies 54 removed. This permits the waste trimmed from the edge sheets ES to be discarded. To push the target 10 out of the central unit 51, an appropriate push piece (not shown) may be positioned between that side panel assembly 54 on the longer projecting ends of rods 55 and the nuts retightened to push the target 10 out. FIG. 10 shows the target partly pushed out.

After the target 10 is unmolded, it is typically finished with a waterproofing agent to enhance its wetness durability. The animal outline may be printed on the target after it is unmolded or may be applied to the edge sheets ES prior to molding.

It will be appreciated that the core is self-adhering to the side pieces 28, edge piece 29 and recess form member 24 as it foams into place. This forms an intimate bond to insure integrity of the target 10 during use.

It has been found that the target 10 incorporating the invention is surprisingly stable when just sitting on a surface such as the ground. This is so even when one tries to shoot arrows at the target 10 with sufficient force to tip the target over.

Figure 11:
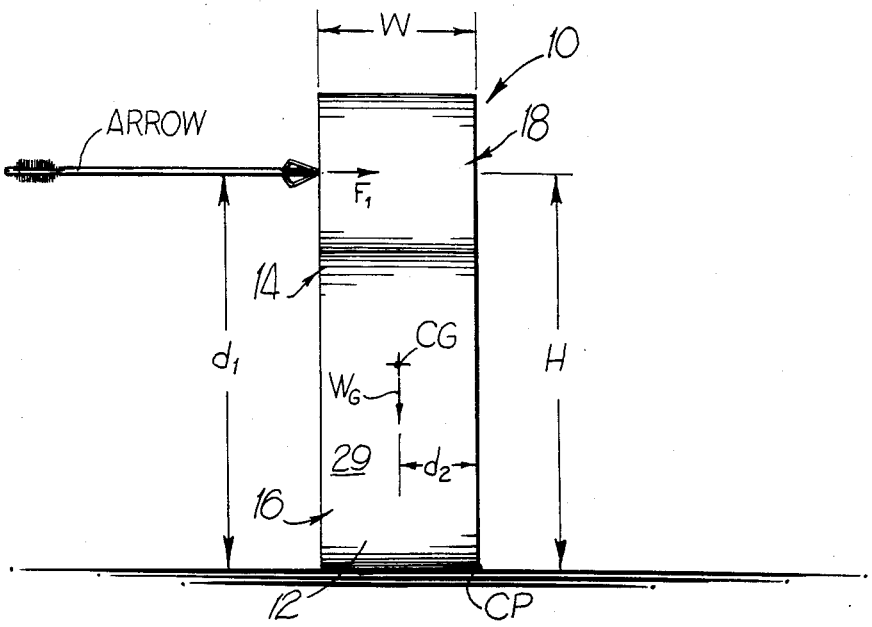
FIG. 11 is a rear end view of the target illustrating its stability.

As best seen in FIGS. 1 and 11 the target 10 has a prescribed overall effective height H, effective length L and effective width W. The weight of target 10 effectively acts through the center of gravity CG. From FIG. 11, it will be seen that the force $F_1$ exerted on the target 10 by the impacting arrow tends to tip the target over about the offside lower corner CP (clockwise as seen in FIG. 11) while the weight $W_G$ tends to oppose this action by tending to tip the target in the opposite direction about corner CP. Thus, it will be seen that the maximum moment exerted by the arrow impacting on the target 10 should not exceed the moment exerted on the target 10 by its weight. This can be written in the limiting condition as:

$$F_1 d_1 = W_G d_2 \quad (1)$$

where $F_1$ is the force exerted on the target 10 by the impacting arrow. Since $d_2$ is equal to $W/2$ and since the weight $W_G$ is equal to $\rho$ HLW where $\rho$ is the core density and since $d_1$ is substantially equal to H, the equation (1) can be rewritten as:

$$F_1 H = \rho HLW \frac{W}{2} \quad (2)$$

and solved as:

$$F_1 = \rho \frac{LW^2}{2} \quad (3)$$

Thus, it will be seen that the limiting maximum force exerted by the arrow impacting the target is a function of core density, effective target length and width but is independent of effective target height. While various values may be used to satisfy the requirements of equation (3), a core density of about 3 lbs./ft.$^3$, an effective length of about 3 feet and a width of about 1 foot have been found satisfactory.

What is claimed as invention is:

1. An archery target comprising a foamed plastic core; a cover enclosing said core, said cover bonded directly to said core by the material of said core and said cover serving to retain said core in place when penetrated by arrows, said cover defining an opening therethrough; and further including a recess form member extending into said core and abutting said cover around said opening, said recess form member defining an outwardly opening recess therein the registration with said opening through said cover.

2. The archery target of claim 1 wherein said foamed plastic core is of the rigid type having closed cells.

3. The archery target of claim 1 wherein said core is a closed cell foamed polyurethane.

4. The archery target of claim 1 wherein said core has been foamed in place within said cover to bond said cover to said core as an incident to the foaming and curing of said core.

5. The archery target of claim 1 further including a handle mounted on said recess form member within said outwardly opening recess.

6. The archery target of claim 1 wherein said cover includes a pair of side pieces covering opposite sides of said core and an edge piece extending around the edge of said core between said side pieces.

7. The archery target of claim 6 wherein said side and edge pieces are corrugated paperboard.

8. An archery target comprising a foamed plastic core; a cover enclosing said core, said cover bonded directly to said core by the material of said core and said cover serving to retain said core in place when penetrated by arrows, said cover including a pair of corrugated paperboard side pieces covering opposite sides of said core and a corrugated paperboard edge piece extending around the edge of said core between said side pieces; said edge piece defining an opening therethrough; and further including a recess form member extending into said core and abutting said cover around said opening, said recess form member defining an outwardly opening recess therein in registration with said opening through said cover.

9. The archery target of claim 8 wherein said core is a closed cell foamed polyurethane.

10. The archery target of caim 9 wherein said core has been foamed in place within said side pieces, said edge piece and said recess form member to bond said core to said side and end pieces and said recess form member as an incident to the foaming and curing of said core.

11. An archery target comprising a foamed plastic core and a cover enclosing said core, said cover bonded directly to said core by the material of said core and said cover serving to retain said core in place when penetrated by arrows, the overall target weight and target width having been selected to offset a sidewise moment of force of a predetermined value exerted on the target by an arrow impacting thereon to prevent sidewise tipping of the target where the core density $\rho$, effective target length L and effective target width W are selected to satisfy the equation:

$$F_1 = \rho L \frac{W^2}{2}$$

with $F_1$ equal to a sidewise force of a prescribed value exerted on the target by an impacting arrow and where the core density is about 3–5 lbs./ft.$^3$; the effective target length is about 3 feet; and the effective target width is about one foot.

* * * * *